US008640716B2

(12) United States Patent
Shimamura

(10) Patent No.: US 8,640,716 B2
(45) Date of Patent: Feb. 4, 2014

(54) COSMETIC APPLICATOR

(75) Inventor: Naomi Shimamura, Yokohama (JP)

(73) Assignee: Shiseido Co., Ltd., Chuo-ku, Tokyo (JP)

( * ) Notice: Subject to any disclaimer, the term of this patent is extended or adjusted under 35 U.S.C. 154(b) by 0 days.

(21) Appl. No.: 13/642,571

(22) PCT Filed: Apr. 19, 2011

(86) PCT No.: PCT/JP2011/059588

§ 371 (c)(1),
(2), (4) Date: Dec. 13, 2012

(87) PCT Pub. No.: WO2011/136078

PCT Pub. Date: Nov. 3, 2011

(65) Prior Publication Data

US 2013/0074868 A1 Mar. 28, 2013

(30) Foreign Application Priority Data

Apr. 27, 2010 (JP) ..... 2010-102181

(51) Int. Cl.
*A45D 40/26* (2006.01)
*A45D 40/24* (2006.01)

(52) U.S. Cl.
USPC ..... 132/320; 132/318; 132/218

(58) Field of Classification Search
USPC ..... 132/320, 317, 218, 200, 318; 401/126, 401/122, 6, 9, 129, 128, 127, 130, 118, 119, 401/139, 261, 266; 15/104.92, 104.93, 107, 15/167.3, 209.1, 210.1, 229.14
See application file for complete search history.

(56) References Cited

U.S. PATENT DOCUMENTS 2,090,354 A * 8/1937 Massman ..... 604/2
2,099,030 A * 11/1937 Morrison ..... 427/274
2,901,100 A * 8/1959 Mueller et al. ..... 401/11

(Continued)

FOREIGN PATENT DOCUMENTS

CN 1572177 A 2/2005
JP 8-38248 2/1996

(Continued)

OTHER PUBLICATIONS

Espacenet Bibliographic data for JP 8038248 published Feb. 13, 1996, two pages.

(Continued)

*Primary Examiner* — Vanitha Elgart
(74) *Attorney, Agent, or Firm* — Rankin, Hill & Clark LLP

(57) ABSTRACT

An object of the present invention is to provide a cosmetic applicator in which a surface of a wide, flat spatula projecting from a shaft includes an application portion formed from flock but the flock does not peel due to friction with a wiping part even after repeated use. In a cosmetic applicator in which electrostatic flocking is implemented on a surface of a spatula formed by forming an application portion in a flat plate shape, forming a root portion in a columnar shape attached to a shaft, and gradually deforming the columnar root portion and the flat application portion from the columnar shape into the plate shape, a projecting portion that projects outward beyond an outer diameter of the shaft is formed on the spatula between the root portion and the application portion, and a part not subjected to flocking is provided between the projecting portion and the root portion.

4 Claims, 3 Drawing Sheets

(56) References Cited

U.S. PATENT DOCUMENTS

| | | | | |
|---|---|---|---|---|
| 3,177,879 | A * | 4/1965 | Smith | 132/320 |
| 4,627,454 | A * | 12/1986 | Dahm | 132/318 |
| 4,856,136 | A * | 8/1989 | Janssen | 15/244.3 |
| 5,176,754 | A * | 1/1993 | Hirzel | 118/258 |
| 5,716,150 | A * | 2/1998 | Gueret | 401/129 |
| 6,033,143 | A | 3/2000 | Gueret | |
| 6,079,423 | A * | 6/2000 | Suzuki | 132/320 |
| 6,220,254 | B1 | 4/2001 | Gueret | |
| 6,227,737 | B1 * | 5/2001 | Lightfoot | 401/129 |
| 6,280,112 | B1 * | 8/2001 | Vieu | 401/122 |
| 6,619,298 | B2 * | 9/2003 | Gueret | 132/320 |
| D538,975 | S * | 3/2007 | Montoli | D28/7 |
| 7,866,327 | B1 * | 1/2011 | Gueret | 132/218 |
| 7,984,721 | B2 * | 7/2011 | Van Alphen | 132/320 |
| 8,250,701 | B1 * | 8/2012 | Forsline et al. | 15/245.1 |
| 8,286,649 | B2 * | 10/2012 | Gueret | 132/320 |
| 8,297,869 | B2 * | 10/2012 | Gueret | 401/266 |
| 2004/0018037 | A1 | 1/2004 | Gueret | |
| 2005/0109365 | A1 * | 5/2005 | Dunton et al. | 132/320 |
| 2007/0181143 | A1 * | 8/2007 | Montoli | 132/320 |
| 2008/0166172 | A1 * | 7/2008 | Eng et al. | 401/37 |
| 2008/0317542 | A1 * | 12/2008 | Gueret | 401/121 |
| 2010/0083976 | A1 * | 4/2010 | Montana-Selers | 132/200 |
| 2010/0129134 | A1 * | 5/2010 | Gueret | 401/122 |
| 2012/0312315 | A1 * | 12/2012 | Gueret | 132/200 |

FOREIGN PATENT DOCUMENTS

| | | |
|---|---|---|
| JP | 11-504555 | 4/1999 |
| JP | 11-222274 | 8/1999 |
| JP | 2001-8727 | 1/2001 |

OTHER PUBLICATIONS

Espacenet Bibliographic data for JP 11222274 published Aug. 17, 1999, two pages.

English abstract for PCT/FR97/00353 which corresponds to JP 11-504555 published Apr. 27, 1999, one page.

Espacenet Bibliographic data for JP 2001008727 published Jan. 16, 2001, two pages.

International Search Report for corresponding PCT/JP2011/059588 mailed May 31, 2011, two pages.

Patent Abstracts of Japan, Publication No. JP 2004-351208 (Corresponds to CN 1572177), 1 page.

Chinese Office Action dated Jun. 24, 2013, 9 pages.

* cited by examiner

COSMETIC APPLICATOR

TECHNICAL FIELD

The present invention relates to a cosmetic applicator.

BACKGROUND ART

A known conventional container for a liquid, paste-form, or gel-form cosmetic such as lipstick, lip gloss, eye shadow, or concealer is constituted by a storage portion filled with the cosmetic and a cap to which an application tool is attached. This type of container is used by extracting the cosmetic from the storage portion with the application tool and applying the cosmetic to the lips or the like, and is employed widely due to its superior portability and usability.

A cosmetic application method for applying shine to the lips has been particularly favored in recent years, and therefore, to ensure that a sufficient amount of cosmetic can be applied in a single application, an application tool in which an applicator is formed in a wide, flat spatula shape that projects from a shaft and a surface of the applicator is subjected to electrostatic flocking (flocking processing) so that the cosmetic can be scooped up easily and the applicator can easily be impregnated with the cosmetic is employed.

When more than a required amount of the cosmetic is adhered to the applicator, however, problems such as straying of the cosmetic onto unintended parts occur during a cosmetic application operation for applying the cosmetic to the lips. Therefore, a wiping part for wiping the applicator to scrape off the excess cosmetic is disposed on an extraction port of the container.

In an application tool having a flat applicator subjected to electrostatic flocking, however, frictional force between the part projecting from the shaft and the wiping part is great, and therefore the flock may peel.

When the cosmetic application tool is withdrawn from the storage portion, the frictional force with the wiping part is greatest in a part of the applicator corresponding to a so-called shoulder of an application portion, which extends from a joint portion joined to the shaft to a projecting portion. As a result, damage such as peeling of the flock increases, causing impairment of the function of the application tool (FIG. 6).

Patent Document 1: Japanese Patent Application Publication No. 2006-346469

DISCLOSURE OF THE INVENTION

An object of the present invention is to provide a cosmetic applicator obtained by implementing electrostatic flocking on a surface of a wide, flat spatula projecting from a shaft, in which peeling of the electrostatic flock due to friction with a wiping part does not occur even after repeated use.

A first invention is a cosmetic applicator in which electrostatic flocking is implemented on a surface of a spatula formed by forming an application portion in a flat plate shape, forming a root portion in a columnar shape attached to a shaft, and gradually deforming the columnar root portion and the flat application portion from the columnar shape into the plate shape, wherein a projecting portion that projects outward beyond an outer diameter of the shaft is formed on the spatula between the root portion and the application portion, and a part not subjected to flocking is provided between the projecting portion and the root portion.

A second invention is a cosmetic applicator in which the part not subjected to flocking is formed by masking an entire circumference between the projecting portion and the root portion.

A third invention is a cosmetic applicator in which the projecting portion that projects outward beyond the outer diameter of the shaft and a maximum projection portion having a greater width than the projecting portion are formed between the root portion and the application portion, and the part not subjected to flocking is provided between the maximum projection portion and the root portion.

A fourth invention is a cosmetic applicator in which a plate-shaped surface of the application portion is formed at a predetermined angle relative to the shaft.

According to the present invention, a cosmetic applicator obtained by implementing electrostatic flocking on a surface of a wide, flat spatula projecting from an outer diameter of a shaft, in which damage such as peeling of the flock due to friction with a wiping part does not occur even after repeated use, can be provided.

BEST MODE FOR CARRYING OUT THE INVENTION

Embodiments of a cosmetic applicator according to the present invention will be described in detail below using the drawings.

Figure 1:
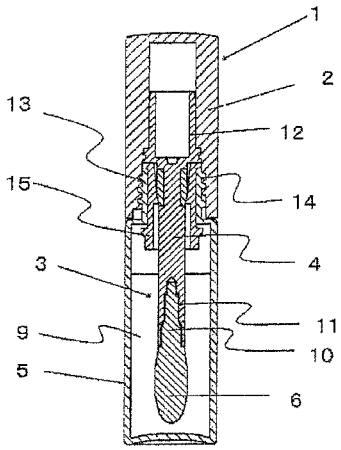
FIG. 1 is a sectional view of a cosmetic container.

FIG. 1 shows an overall configuration of a cosmetic container incorporating the cosmetic applicator according to the present invention. A cosmetic container (1) is constituted by a storage portion (5) filled with a cosmetic, and a cap (2). A cosmetic application tool (3) for extracting the cosmetic and applying the cosmetic to the lips and so on is provided on the cap (2). In the cosmetic application tool (3), a shaft (4) is joined to an applicator (6) such that one end portion of the shaft (4) is joined to the cap (2) and another end portion is joined to the applicator (6). The joint between the shaft (4) and the applicator (6) is formed by inserting a holding portion (10) provided on an end of the applicator (6) fixedly into a holding hole (11) provided in the end portion of the shaft. Further, the cosmetic application tool (3) is attached to the cap (2) so as to be submerged in the cosmetic filling the storage portion (5) when the cap (2) is screwed to the storage portion (5).

Figure 2:
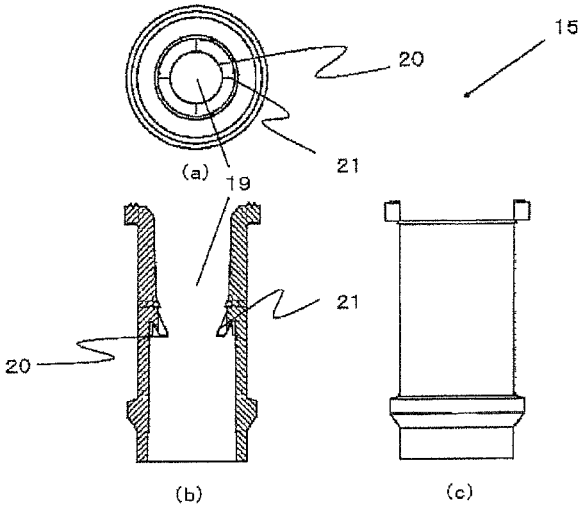
FIGS. 2(*a*), 2(*b*), and 2(*c*) are, respectively, a front view, a sectional view, and a side view of a wiping part.

A wiping part (15) is disposed in the vicinity of a cosmetic extraction port of the storage portion such that when the cosmetic application tool (3) is withdrawn from the storage portion (5), excess cosmetic adhered to the shaft (4) and the applicator (6) is scraped away by an inner hole edge (20) of the wiping part. Further, as shown in FIG. 2, an inner hole (19)

of the wiping part (15) takes a non-directional circular shape so that the cosmetic application tool can be withdrawn by rotating the cap. The applicator (6) of the cosmetic application tool (3) takes a wide, flat shape, and therefore, to ensure that frictional force between the applicator (6) and the inner hole edge (20) does not increase unnecessarily, a slit (21) is provided in the inner hole (19) of the wiping part (15). Nitrile butadiene rubber (NBR) is used as a material of the wiping part (15), but the wiping part (15) is not limited thereto.

Figure 3:
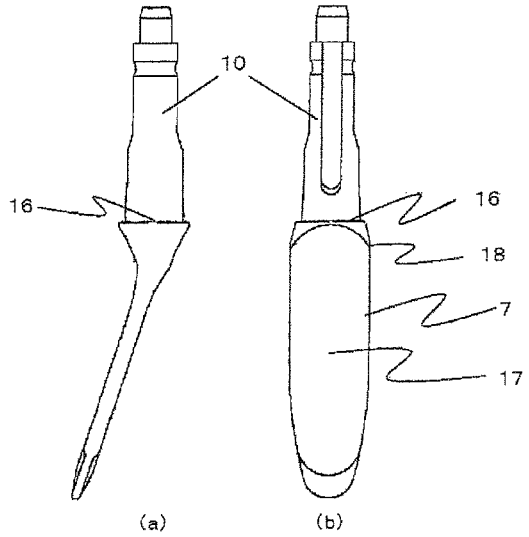
FIGS. 3(*a*) and 3(*b*) are, respectively, a side view and a front view of a spatula and a holding portion.

FIG. 3 shows a shape of a spatula (7) that forms a base of the applicator (6). The spatula (7) is constituted by a flat plate-shaped application portion (17) and a columnar root portion (16). The columnar root portion (16) and the flat application portion (17) deform gradually from the columnar shape to the plate shape such that a projecting portion (18) that projects outward beyond an outer diameter of the shaft is formed between the root portion (16) and the application portion (17). By forming the application portion (17) in a wide, flat shape, a sufficient amount of the cosmetic can be scooped up, and the cosmetic can easily be applied widely over the lips and so on. Further, the holding portion (10) inserted fixedly into the shaft (4) is molded integrally with the spatula (7).

It is necessary for the applicator (6) to fit the shape of the lip, and therefore a material having an appropriate degree of elasticity must be selected for the spatula (7). Further, the applicator (6) is in contact with the cosmetic at all times, and therefore a chemically stable material that does not interact with the cosmetic must be used. Accordingly, the material forming the spatula (7) is preferably an elastomer resin, and preferred examples of the elastomer resin include thermoplastic elastomer and polyurethane elastomer.

To facilitate operations for scooping up the cosmetic and applying the cosmetic to the lips or the like, the spatula (7) preferably has a width of approximately 4.1 to 6.0 mm, a length of approximately 12 to 18 mm, and a thickness of approximately 0.9 to 4 mm. Depending on the type of cosmetic, however, the spatula (7) is not limited to these dimensions. Further, the application portion of the spatula may be tilted in a flat surface direction so as to have a predetermined angle relative to the shaft. To facilitate a cosmetic application operation, the angle is preferably between approximately 10 and 30 degrees.

Figure 4:
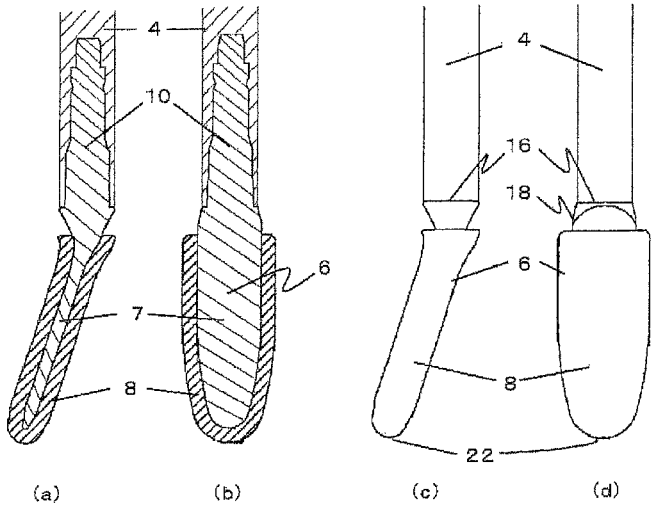
FIGS. 4(*a*), 4(*b*), 4(*c*), and 4(*d*) are, respectively, a side sectional view, a front sectional view, a side view, and a front view of a cosmetic application tool incorporating (a first embodiment of) a cosmetic applicator according to the present invention.

The spatula (7) serves as the base of the applicator (6), and electrostatic flocking (flocking processing) is implemented on a surface thereof (FIG. 4). By implementing flocking on the smooth surface of the spatula, the spatula can be impregnated with the cosmetic, enabling even application of the cosmetic over a comparatively wide range. During use, cosmetic (9) in the storage portion (5) is scooped up by the applicator (6), whereupon the cosmetic application tool (3) is withdrawn from the storage portion (5) and excess cosmetic adhered to the shaft (4) and the applicator (6) is wiped away by the inner hole edge (20) of the wiping part (15). The cosmetic is then applied to the lips and so on.

There are no particular limitations on the material, thickness, and length of the fiber used in the electrostatic flocking (flocking processing), but nylon or polyester resin fiber having a thickness of approximately 0.9 to 3.3 T (Digitex) and a length of approximately 1 mm, which is typically used for electrostatic flocking implemented on cosmetic tools, is preferable.

Figure 6:
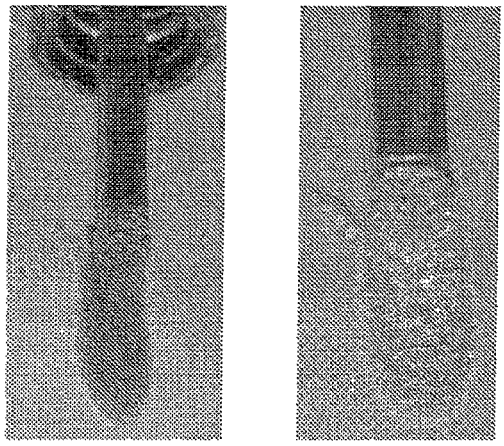
Fig. 6 (Prior Art)
FIG. 6 is a view (a photographic substitute for a diagram) showing peeling of flock in a conventional cosmetic applicator.

The wiping part (15) scrapes away excess cosmetic adhered to the shaft (4) and the applicator (6). Therefore, a diameter of the inner hole (19) of the wiping part is set to be slightly smaller than the outer diameter of the shaft (4) such that when the cosmetic application tool is withdrawn, an increase occurs in the frictional force generated between the part of the application portion (17) that projects beyond the outer diameter of the shaft (4) and the inner hole edge (20) of the wiping part. Hence, when electrostatic flocking is implemented on this part, damage such as peeling of the flock occurs, as shown in FIG. 6. Note that a diameter of the inner hole (16) of the wiping part is approximately 3.6 mm, and the outer diameter of the shaft (4) is approximately 4 mm.

FIG. 4 shows an embodiment of the cosmetic applicator according to the present invention. By forming the projecting portion (18) that projects outward beyond the outer diameter of the shaft (4) between the root portion (16) and the application portion (17), the spatula (7) can be formed as a wide, flat application portion. Further, a part not subjected to flocking is provided between the projecting portion (18) and the root portion (16), and in this part, the surface of the spatula (7) serving as the base is exposed as a smooth surface. When the applicator (6) passes through the inner hole (19) of the wiping part (15), a part extending from the root portion (16) to the projecting portion (18) of the applicator (6) serves as a part that pushes open the inner hole of the wiping part, and therefore maximum frictional force is exerted in this location, causing the flock to peel greatly (FIG. 6). By forming this part as a smooth surface, peeling of the flock is avoided, and as a result, damage to the applicator can be prevented. By structuring the applicator (6) in this manner, it is possible to provide a cosmetic applicator in which electrostatic flocking is implemented on the wide, flat spatula but the flock does not peel due to friction with the wiping part even after repeated use.

Further, when the plate-shaped surface of the application portion (17) is provided at a predetermined angle relative to the shaft (4), the part between the root portion (16) and the projecting portion (18) of the applicator (6) easily catches on the wiping part during withdrawal of the application tool, and therefore a further increase occurs in the frictional force received from the wiping part, causing even greater damage. Hence, a superior effect is obtained by forming this part as a smooth surface not subjected to flocking.

To mass-produce the cosmetic applicator according to the present invention, masking is applied to an entire circumference of the part between the root portion (16) and the projecting portion (18). Thus, the part between the root portion (16) and the projecting portion (18) can be formed as a smooth surface while simplifying a masking process performed during electrostatic flocking.

Electrostatic flocking (flocking processing) is a surface processing technique in which a subject is coated with an adhesive and short fibers (pile) are implanted by applying a powerful electric field to the adhesive. As a result, a velvety finish is obtained. When the subject includes a part to be subjected to the electrostatic flocking and a part not to be subjected to the electrostatic flocking, a masking process must be implemented on the part not to be subjected to the electrostatic flocking so that the adhesive does not adhere to this part. Further, when a plurality of masking locations exist or the masking location is very small, the process becomes more complicated, leading to problems in terms of operability, production cost, and so on. It is therefore important to simplify the masking process as far as possible during mass-production.

In the cosmetic applicator according to the present invention, masking is performed by covering the entire circumference of the location to be formed as a smooth surface, i.e. the part between the root portion (16) and the projecting portion (18), and therefore the masking location is small and has a simple shape. As a result, an improvement in efficiency can be achieved during mass-production.

During mass-production of the cosmetic applicator, the adhesive is applied after performing the masking process for covering the entire circumference of the part of the applicator (6) between the root portion (16) and the projecting portion (18). At this time, mass-production irregularities such as deviation of the masking position and infiltration of the adhesive through a gap in a mask such that the adhesive adheres to the spatula must be taken into consideration. Hence, to prevent adhesion of the adhesive to the part between the root portion (16) and the projecting portion (18) reliably in the masking process performed during mass-production, an entire circumference of a part extending from the projecting part (18) to a position approximately 1 to 3 mm away in a tip end (22) direction is preferably covered, thereby ensuring covering up to a site where the projecting portion (18) begins to deform from the columnar shape into the flat shape.

Figure 5:
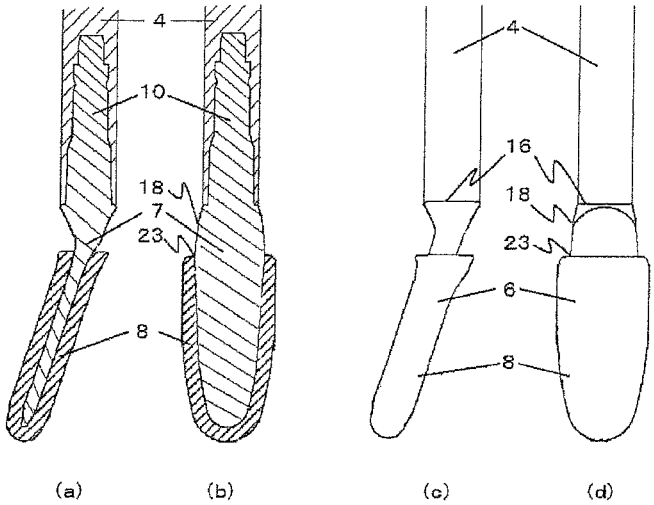
FIGS. 5(*a*), 5(*b*), 5(*c*), and 5(*d*) are, respectively, a side sectional view, a front sectional view, a side view, and a front view of a cosmetic application tool incorporating (a second embodiment of) the cosmetic applicator according to the present invention.

The spatula is shaped to be wider than the projecting portion (18) formed between the root portion (16) and the application portion (17), and a maximum projection portion (23) having a maximum width may be formed on the application portion (FIG. 5). In this case, a part extending from the root portion (16) to the maximum projection portion (23) is formed as a smooth surface not subjected to electrostatic flocking. The reason for this is to prevent serious damage to the flock caused by friction with the wiping part in the part extending from the root portion (16) to the maximum projection portion (23).

EXPLANATION OF REFERENCE NUMERALS

1 cosmetic container
2 cap
3 cosmetic application tool
4 shaft
5 storage portion
6 applicator
7 spatula
8 electrostatic flock
9 cosmetic
10 holding portion
11 holding hole
12 fixing portion
13 male screw
14 female screw
15 wiping part
16 root portion
17 application portion
18 projecting portion
19 inner hole
20 inner hole edge
21 slit
22 tip end
23 maximum projection portion

The invention claimed is:

1. A cosmetic applicator comprising:
a shaft; and
a spatula attached to the shaft;
wherein the spatula has a surface and includes a root portion, an application portion and a projecting portion,
wherein the root portion has a columnar shape and is attached to the shaft,
wherein the shape of the application portion is a flat plate shape formed by gradually deforming from the root portion,
wherein the projecting portion extends between the root portion and the application portion,
wherein the projecting portion projects at its width outward beyond an outer diameter of the shaft,
wherein the application portion includes a maximum projection portion having width greater than the projecting portion, and
wherein electrostatically-applied flocking is implemented on the surface of the spatula, but a part not subjected to flocking is provided between the maximum projection portion and the root portion.

2. The cosmetic applicator according to claim 1, wherein the part of the spatula not subjected to flocking is formed by masking an entire circumference between said maximum projection portion and said root portion when the flocking is electrostatically applied.

3. The cosmetic applicator according to claim 1, wherein the flat plate-shaped application portion lies in a plane that is disposed at a predetermined angle relative to the shaft.

4. The cosmetic applicator according to claim 2, wherein the flat plate-shaped application portion lies in a plane that is disposed at a predetermined angle relative to said shaft.

* * * * *